US008331844B2

(12) United States Patent
DiMatteo

(10) Patent No.: US 8,331,844 B2
(45) Date of Patent: Dec. 11, 2012

(54) PROOF PRINTING USING RECYCLED MARKING MATERIAL

(75) Inventor: Guido DiMatteo, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 454 days.

(21) Appl. No.: 12/760,034

(22) Filed: Apr. 14, 2010

(65) Prior Publication Data

US 2011/0255903 A1 Oct. 20, 2011

(51) Int. Cl.
*G03G 21/10* (2006.01)
*G03G 15/00* (2006.01)

(52) U.S. Cl. ..... 399/358; 399/15

(58) Field of Classification Search ..... 399/130, 399/120, 359, 358, 14, 15, 10
See application file for complete search history.

(56) References Cited

U.S. PATENT DOCUMENTS

| | | | |
|---|---|---|---|
| 4,418,643 | A | 12/1983 | Barto, Jr. et al. |
| 5,329,297 | A | 7/1994 | Sanger et al. |
| 5,947,022 | A | 9/1999 | Freeman et al. |
| RE36,535 | E | 1/2000 | Hicks |
| 6,324,973 | B2 | 12/2001 | Rossmeisl et al. |
| 6,892,045 | B2 | 5/2005 | Tokimatsu et al. |
| 6,897,003 | B2 | 5/2005 | Harada et al. |
| 7,330,690 | B2 | 2/2008 | Amano et al. |
| 2002/0067938 | A1 | 6/2002 | Saitoh et al. |
| 2008/0008481 | A1 | 1/2008 | Takahashi et al. |

FOREIGN PATENT DOCUMENTS

| | | | |
|---|---|---|---|
| JP | 201125450 | | 5/2001 |
| JP | 2001281916 | | 10/2001 |
| JP | 2001281916 | A * | 10/2001 |
| JP | 2003173088 | | 6/2003 |

* cited by examiner

*Primary Examiner* — Susan Lee
(74) *Attorney, Agent, or Firm* — Gibb & Riley, LLC

(57) ABSTRACT

Methods and systems supply used marking material to a printing device marking material supply container. The used marking material was previously used in a printing process and was previously removed from one or more photoreceptors. The methods/systems feed the used marking material from the material supply container to a photoreceptor within the printing device and transfer the used marking material to a sheet of media in a printing process performed by the printing device that produces "proof prints." These proof prints are printed sheets that are used to verify content and/or layout of printed material. The proof prints are not required to comply with any print quality or print durability standard. The methods/systems also fuse (using a heating element within the printing device) the used marking material to the sheet of media at a reduced temperature that is insufficient to comply with any print quality or print durability standard.

20 Claims, 3 Drawing Sheets

PROOF PRINTING USING RECYCLED MARKING MATERIAL

BACKGROUND AND SUMMARY

Embodiments herein generally relate to printing devices that are utilized in proofing processes, and more particularly to specialized methods and proof printing devices that utilize used marking material.

There is currently no way to recycle and/or reuse the waste toner/developer deposited in the printer waste toner bottle for any print device using dry ink toner and developer. This inability to recycle the waste toner and developer particulates costs hundreds of thousands of dollars per year in industrial waste disposal charges and replacement toner/developer production, distribution, and purchasing. Additionally, there is no cost reduced solution available to the customer for generating proof prints using recycled materials, nor is there a system designed to reduce power consumption by eliminating the separate toner and developer dispenser modules and reducing the temperature of the fuser.

More specifically, current processes for disposing of industrial waste toner materials require the customer to package the waste toner bottles in a sealed box and ship to local landfill for disposal. It can cost, for example, $75 per ton of material to be disposed of at a landfill (not including shipping) and it can cost $175 per ton of material to be disposed of at power generation stations where the materials are burned as fuel to produce electricity (this does not include shipping and dock charges).

In view of the foregoing, the embodiments herein provide a low-resolution, reduced power consumption, hopper fed dry ink toner and developer proof printer that accepts, as input, the waste toner and developer from any laser or electrophotographic print device. The embodiments herein recycle waste materials, lower environmental impacts of hard-copy proofs for layout validation, and provide a low cost environmentally friendly printing alternative through component reduction and minimal power consumption.

One exemplary method embodiment herein supplies used marking material to a marking material supply container within a printing device. The used marking material was previously used in a previous printing process and was previously removed from one or more photoreceptors. The method feeds the used marking material from the material supply container to a photoreceptor within the printing device and transfers the used marking material to a sheet of media in a printing process performed by the printing device that produces proof prints.

These "proof prints" are printed sheets that are used in a proofing process to verify content and/or layout of printed material. The proof prints are not required to comply with a print quality or print durability standard, but instead are merely used in the preliminary print proofing process to verify that later print runs performed on other higher quality printing machines will be error free. The used marking material can comprise toner, developer, and debris, and may be of many different colors (including black). Therefore, the used marking material can produce prints having inconsistent colors and printing defects; however, because proof prints are only used to verify layout, content, etc., inconsistent coloration and printing defects will not affect the proofing process.

The method also fuses (using a heating element within the printing device) the used marking material to the sheet of media at a reduced temperature. The reduced fusing temperature can also produce prints that are insufficient to comply with print quality or print durability standards; however, because the proof prints are again only used briefly and are only used to verify layout, content, etc., such defects in printing quality and durability are acceptable.

In one embodiment, for ease of use, the method can provide for supplying the used marking material by loading the used marking material into a material hopper positioned on the exterior of the printing device. Also, in other embodiments, after transferring the used marking material to the sheet of media, the methods herein can remove excess marking material from the photoreceptor, and directly feed the excess marking material internally within the printing device to the marking material supply container, thereby eliminating any need to collect and remove used marking material from the printing device.

A specialized proof printing device is also disclosed herein. This specialized proof printing device includes a marking material supply container containing used marking material. As described above, the used marking material was previously used in a previous printing process. With this specialized device, a photoreceptor is positioned adjacent the marking material supply container, and the marking material supply container feeds the used marking material to the photoreceptor. A sheet transport device is also included adjacent the photoreceptor. The sheet transport device feeds one or more sheets of media to the photoreceptor, and the photoreceptor transfers the used marking material to the sheet of media in a printing process performed by the printing device that produces proof prints.

As discussed above, the proof prints are printed sheets used to verify the content/layout of printed material, and are not required to comply with a print quality or print durability standard. Further, a heating element is positioned adjacent the photoreceptor. The heating element fuses the used marking material to the sheet of media at a reduced temperature that is insufficient to comply with the print quality or print durability standard.

In optional embodiments, the proof printing device can include a material hopper. This hopper can be partially or fully positioned on the exterior of the printing device and has an opening that is accessible to the user or automated material supply devices, and is shaped to easily receive the used marking material. The material hopper includes necessary physical features to transfer the used marking material and load the used marking material into the marking material supply container.

In other optional embodiments, the proof printing device can include a cleaning device that is positioned adjacent the photoreceptor and contacts the photoreceptor. The cleaning device includes brushes that remove excess marking material from the photoreceptor that is left on the photoreceptor after the used marking material has been transferred to the sheet of media. Rather than collecting and storing the excess marking material, embodiments herein can include a material transport device that is connected to the cleaning device. The material transport device feeds the excess marking material from the cleaning device to the marking material supply container within the printing device.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, there is currently no way to recycle and/or reuse unprocessed waste toner/developer deposited in the printer waste toner bottle for any print device using dry ink toner and developer. This inability to directly recycle waste toner and developer particulates costs hundreds of thousands of dollars per year in industrial waste disposal charges and replacement toner/developer production, distribution, and purchasing.

With embodiments herein, the specialized proof printing device produces a low image quality single color print and accepts, as an input marking material, various combinations of unprocessed/untreated waste toner and developer from any laser or electrophotographic printer waste toner bottle. The specialized proof printing device can include a hopper that has a waste material mixer/agitator, a friction static generation system for recharging spent toner particulates, and a particle transport (auger or conveyor) that feeds mixed materials into a combined toner and developer dispenser container. This container then feeds the materials through the print engine and low temperature fuser (for reduced power consumption) to deliver low resolution proofs on exclusively recycled paper at reduced cost.

The embodiments herein use a waste dry ink toner and developer feed hopper with integrated mixer/agitator and material transport assembly, and a waste dry ink toner and developer dispenser module in a friction static recharge generation system to provide a cartridge-less print system that runs on waste material and provides proof printing based on 100% recycled materials. The embodiments herein eliminate waste by reclaiming all unused toner and developer (unprocessed/untreated), and provide environmentally friendly printing, reduced power consumption, and a low cost proofing alternative.

The word "printer" or "printing device" as used herein encompasses any apparatus, such as a digital copier, bookmaking machine, facsimile machine, multi-function machine, etc., which performs a print outputting function for any purpose. The embodiments herein specifically apply to any direct-to-paper technology (xerographic, inkjet, etc.). The details of printers, printing engines, etc., are well-known by those ordinarily skilled in the art and are discussed in, for example, U.S. Patent Publication 2008/0061499, the complete disclosure of which is fully incorporated herein by reference.

Figure 1:
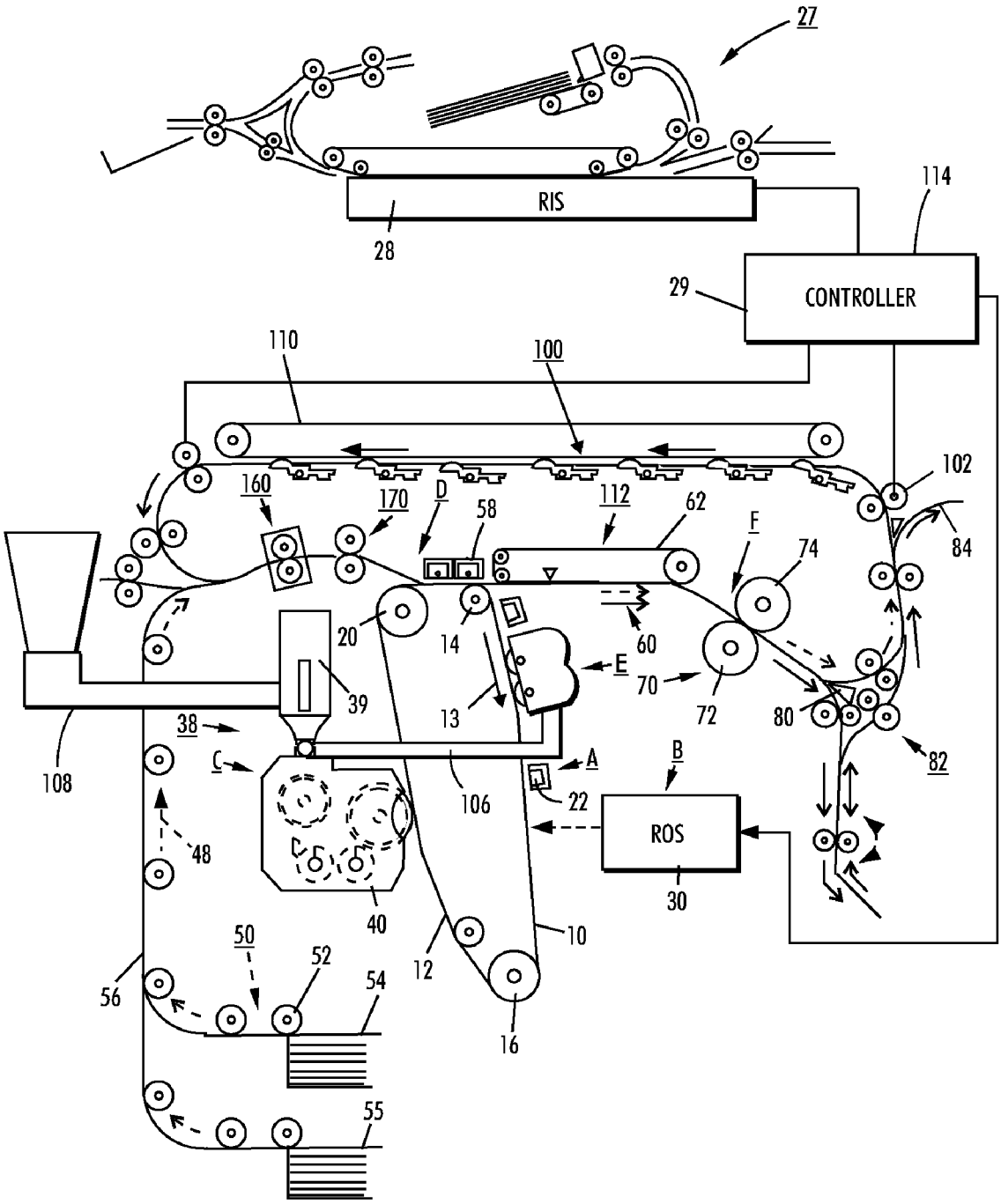
FIG. 1 is a side-view schematic diagram of a device according to embodiments herein.

While FIG. 1 describes an electrophotographic printing machine, those ordinarily skilled in the art would understand that the present embodiments are equally applicable to any form of printing machine, whether now known or developed in the future. For example, the embodiments herein are especially applicable to direct printing architectures including inkjet-based printing, ribbon-based printing, etching, etc. For a full discussion of one example of direct printing architectures see U.S. Patent Publication Number 2009/0009573 and the patents and publications listed therein (the complete disclosures of which are incorporated herein by reference).

For example, FIG. 1 schematically depicts an electrophotographic printing machine that is similar to one described in U.S. Patent Publication 2008/0061499. It will become evident from the following discussion that the present embodiments may be employed in a wide variety of devices and are not specifically limited in its application to the particular embodiment depicted in FIG. 1.

FIG. 1 schematically depicts an electrophotographic printing machine incorporating the features of the present disclosure therein. FIG. 1 illustrates an original document positioned in a document handler 27 on a raster input scanner (RIS) indicated generally by the reference numeral 28. The RIS contains document illumination lamps; optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine, which generally employs a photoconductive belt 10. Preferably, the photoconductive belt 10 is made from a photoconductive material coated on a grounded layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example, a raster output scanner (ROS), indicated generally by reference numeral 30. Preferably, ESS 29 is a self-contained, dedicated minicomputer. The image signals transmitted to ESS 29 may originate from a RIS as described above or from a computer through a network connection input/output 112, thereby enabling the electrophotographic printing machine to serve as a remotely located printer for one or more computers. Alternatively, the printer may serve as a dedicated printer for a high-speed computer connected to the input/output 112.

The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by raster basis.

After the electrostatic latent image has been recorded on photoconductive surface 12, belt 10 advances the latent image to a development station C, where used toner, in the form of liquid or dry particles, is electrostatically attracted the latent image using commonly known techniques. The latent image attracts toner particles from the carrier granules forming a toner powder image thereon. As successive electrostatic latent images are developed, toner particles are depleted from the developer material. A toner particle dispenser that contains used marking material and is sometimes referred to herein as a used marking material supply a container, indicated generally by the reference numeral 39, dispenses toner particles into developer housing 40 of developer unit 38.

With continued reference to FIG. 1, after the electrostatic latent image is developed, the toner powder image present on belt 10 advances to transfer station D. A print sheet 48 is advanced to the transfer station D, by a sheet feeding apparatus, 50. Preferably, sheet feeding apparatus 50 includes a feed rolls 52 and 53 contacting the uppermost sheet of stacks 54 and 55, respectively. Feed roll 52 rotates to advance the uppermost sheet from stack 54 into vertical transport 56. Vertical transport 56 directs the advancing sheet 48 of support material into pre-registration device 160 which in conjunction with stalled roll registration mechanism 170 moves a now registered sheet 48 past image transfer station D to receive an image from photoreceptor 10 in a timed sequence so that the toner powder image formed thereon contacts the advancing sheet 48 at transfer station D. Transfer station D includes a corona generating device 58, which sprays ions onto the back side of sheet 48. This attracts the toner powder image from photoconductive surface 12 to sheet 48. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roll 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor, which controls the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets. Further, the controller 29 includes a computer readable storage medium that stores instructions that are executed by the controller to allow the printing device to perform the various functions that are described herein.

Thus, as shown above, a marking material donor roll 40 is adjacent the photoreceptor 10, the marking material donor roll 40 transfers marking material to areas of the photoreceptor 10 having the latent image charge, such that the marking material is patterned into an image pattern according to the latent image charge on the photoreceptor 10. Also, a sheet transport device 170 is adjacent the photoreceptor 10, the sheet transport device 170 supplies at least one sheet of media 54, 55 to the photoreceptor 10. The photoreceptor 10 transfers the marking material to the sheets of media in the image pattern. A fuser F is adjacent the photoreceptor 10, and the fuser permanently attaches the marking material to the sheet of media in the image pattern.

The printing device shown in FIG. 1, comprises a specialized proof printing device. Therefore, the marking material supply container 39 contains used marking material. As described above, the used marking material is unprocessed/untreated and was used in a previous printing process. As shown above, the photoreceptor 10 is positioned adjacent the marking material supply container 39, and the marking material supply container 39 feeds the used marking material to the photoreceptor 10 using, for example, well-known brushes, rolls, doner devices, etc. A sheet transport device 170 is also included adjacent the photoreceptor 10. The sheet transport device 170 feeds one or more sheets of media to the photoreceptor 10, and the photoreceptor 10 transfers the used marking material to the sheet of media in a printing process performed by the printing device that produces proof prints.

These "proof prints" are printed sheets that are used in a proofing process to verify content and/or layout of printed material. The proof prints are not required to comply with any print quality or print durability standard, but instead are merely used in the preliminary print proofing process to verify that later print runs performed on other higher quality printing machines will be error free. The used marking material is unprocessed/untreated and can comprise toner, developer, and debris, and may be of many different colors (including black). Therefore, the unprocessed/untreated used marking material can produce prints having inconsistent colors and printing defects; however, because proof prints are only used to verify layout, content, etc., inconsistent coloration and printing defects will not affect the proofing process.

As noted above, a fusing or heating element F is positioned adjacent the photoreceptor 10. The heating element F fuses the used marking material to the sheet of media at a reduced temperature that is insufficient to comply with the print quality or print durability standard; however, again because proof prints are only used to verify layout, content, etc., reduced durability will not affect the proofing process.

In optional embodiments, the proof printing device can include a material hopper 108. This hopper 108 can be partially or fully positioned on the exterior of the printing device. As shown in greater detail in FIG. 3, the hopper 108 has an opening 302 that is accessible to the user or automated material supply devices. The opening 302 can be optionally covered with any form of lid or cover 308 (e.g., rubber/butyl etc.), that can be optionally hinged, to eliminate airborne toner particulates from escaping. Therefore, for example, the opening 302 could be positioned on an exterior portion of the printing device and is large enough to allow the user (or automated transport devices such as belts, hoses, etc.) to easily pour unprocessed/untreated used marking material into the hopper 108. Other portions of the hopper 108 could be contained internally within the printing device. The size and position of the hopper 108 is dependent upon the specific configuration of the printing device and of the components that supply the used marking material to the printing device.

Further, the hopper 108 has a tapered body shaped to receive the used marking material. The material hopper 108 includes necessary physical features such as augers, belts, tubes, and mixers 304, 306 (e.g., a vacuum assisted feed hose) to transfer the used marking material and load the used marking material into the marking material supply container 39. Further, items 304 and 306 represent a friction static generation system that recharges the spent toner particulates. In other words, as items 304 and 306 rotate, they create static electrical charges within the used marking material particles, thereby making the used marking material particles very similarly charged to newly manufactured marking material particles. This allows the used marking material particles to be processed through the printing engine in a similar manner, and using similar equipment, as newly manufactured marking material particles.

In other optional embodiments, the proof printing device can include a cleaning device E that is positioned adjacent the photoreceptor 10 and contacts the photoreceptor 10. The cleaning device F includes brushes that remove excess marking material from the photoreceptor 10 that is left on the photoreceptor 10 after the used marking material has been transferred to the sheet of media. Rather than collecting and storing the excess marking material, embodiments herein can include a material transport device 106 that is connected to the cleaning device. As shown in greater detail in FIG. 4, the material transport device also includes various augers, belts, tubes, mixers, etc., 402 that transport the excess marking material from the cleaning device to the marking material supply container 39 within the printing device.

Figure 3:
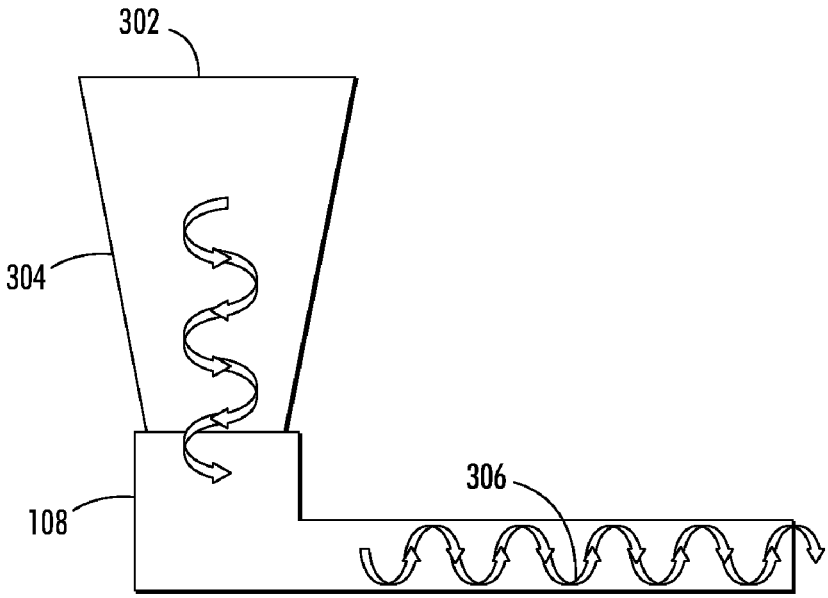
FIG. 3 is a side-view schematic diagram of a device according to embodiments herein.
Figure 4:
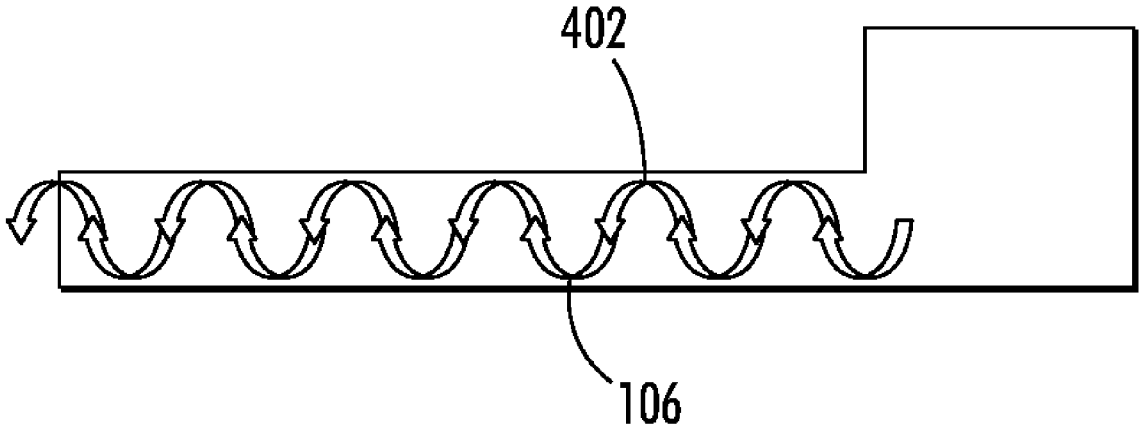
FIG. 4 is a side-view schematic diagram of a device according to embodiments herein.

While various structures are shown in FIGS. 1, 3, and 4, those ordinarily skilled in the art would understand that the embodiments herein are not limited to the specific structures that are illustrated, but instead are applicable to all similar devices. The structures shown in FIGS. 1, 3, and 4 are merely examples of ways in which the embodiments may be presented, and many other devices are contemplated as being included within the claim devices below.

Further, the embodiments herein can comprise a hybrid printing devices that can alternatively use recycled marking material and operate at lower fusing temperatures when performing proof printing operations. Then, when in normal high quality print mode (non-proof printing mode) the marking material supply container 39 can be filled with newly manufactured (not recycled) marking material and newly manufactured developer and the controller 29 can control the fuser F to perform fusing at higher temperatures that allow the printing device to comply with print quality and print durability standards. When operating in high quality print mode, the material transport device 106 would be controlled by the controller 29 to not return used marking material to the marking material supply container 39.

As mentioned above, by performing the proof printing process with the used marking material, the printing device shown in FIG. 1 provides an acceptable printed product for printing purposes and reduces waste by recycling material that would otherwise be disposed of. This reduces costs associated with disposal of used marking material, eliminates the costs of supplying new marking material to the proof printing device, and provides environmental benefits by reducing the volume of items that are supplied to landfills.

Figure 2:
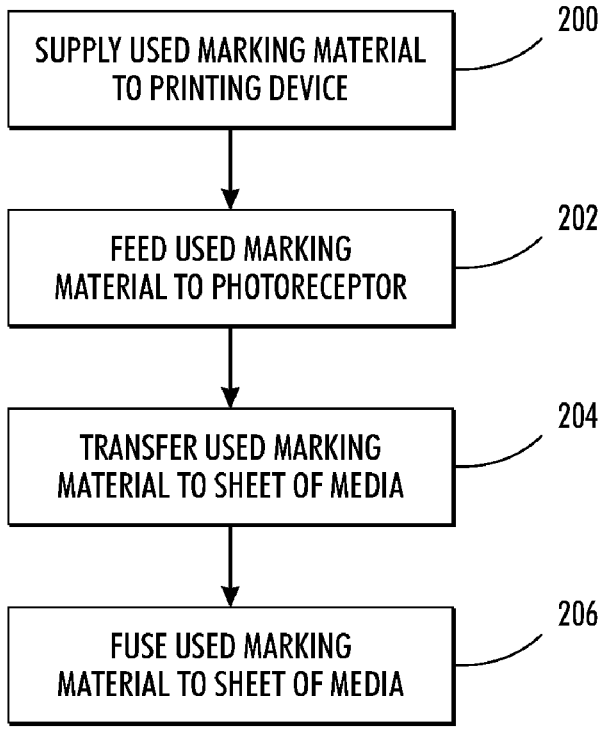
FIG. 2 is a flow diagram illustrating method embodiments herein.

As shown in FIG. 2, one exemplary method embodiment herein supplies used marking material to a marking material supply container within a printing device (item 200). As described above, the used marking material was previously used in a previous printing process and was previously removed from one or more photoreceptors.

In one embodiment, for ease of use, the method can provide for supplying the used marking material (item 200) by loading the used marking material into a material hopper positioned on the exterior of the printing device. Also, in other embodiments, after transferring the used marking material to the sheet of media, item 200 can be performed by removing remove excess marking material from the photoreceptor, and directly feeding the excess marking material internally within the printing device to the marking material supply container, thereby eliminating any need to collect and remove used marking material from the printing device.

In item 202, this exemplary method feeds the used marking material from the material supply container to a photoreceptor within the printing device. In item 204, the photoreceptor transfers the used marking material to a sheet of media in a printing process performed by the printing device that produces proof prints. As discussed above, the proof prints are printed sheets used to verify the content/layout of printed material, and are not required to comply with any print quality or print durability standard.

The method also fuses (using a heating element within the printing device) the used marking material to the sheet of media at a reduced temperature in item 206. The reduced fusing temperature can also produce prints that are insufficient to comply with any print quality or print durability standard; however, because the proof prints are again only used briefly and are only used to verify layout, content, etc., such defects in printing quality and durability are acceptable.

More specifically, the "reduced fusing temperature" is reduced relative to printing devices that do comply with the various print quality and durability standards. Thus, for example, if a high quality printer normally requires fusing at temperatures in the range 600-800° C. in order to ensure that print quality and print durability standards are maintained, the embodiments herein perform fusing at temperatures in the range of 400-600° C. However, the embodiments herein are not limited to any specific temperature ranges, because different marking materials have different melting temperatures that are required in order to maintain specific print quality and print durability standards State another way, the embodiments herein perform the fusing process at a temperature that is a predetermined percentage (e.g., 10%, 15%, 20%, 25%, etc.) below the minimum recommended fusing temperature for a given printing device and/or a given marking material type. The reduced fusing temperatures improve the environmental impact of the proof printing device described herein by reducing its energy consumption requirements. Energy consumption can be saved by using lower power fusers or controlling the temperature output by higher power fusing device.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

What is claimed is:

1. A method comprising:

supplying used marking material to a marking material supply container within a printing device, said used marking material being previously used in a previous printing process and previously removed from one or more photoreceptors;

feeding said used marking material from said material supply container to a photoreceptor within said printing device; and transferring said used marking material to a sheet of media in a printing process performed by said printing device that produces proof prints, said proof prints comprising printed sheets used to verify at least one of content and layout of printed material, said proof prints not being required to comply with a print quality or print durability standard.

2. The method according to claim 1, said supplying of said used marking material comprising loading said used marking material into a material hopper positioned on an exterior of said printing device.

3. The method according to claim 1, further comprising after said transferring of said used marking material to said sheet of media, removing excess marking material from said photoreceptor and feeding said excess marking material to said marking material supply container within said printing device.

4. The method according to claim 1, said used marking material comprising different colors of used marking materials, said used marking material producing prints having inconsistent colors.

5. The method according to claim 1, said used marking material is unprocessed and untreated and comprises toner, developer, and debris.

6. A method comprising:

supplying used marking material to a marking material supply container within a printing device, said used marking material being previously used in a previous printing process and previously removed from one or more photoreceptors;

feeding said used marking material from said material supply container to a photoreceptor within said printing device;

transferring said used marking material to a sheet of media in a printing process performed by said printing device that produces proof prints, said proof prints comprising printed sheets used to verify at least one of content and layout of printed material, said proof prints not being required to comply with a print quality or print durability standard; and fusing, using a heating element within said printing device, said used marking material to said sheet of media at a temperature that is insufficient to comply with said print quality or print durability standard.

7. The method according to claim 6, said supplying of said used marking material comprising loading said used marking material into a material hopper positioned on an exterior of said printing device.

8. The method according to claim 6, further comprising, after said transferring of said used marking material to said sheet of media, removing excess marking material from said photoreceptor and feeding said excess marking material to said marking material supply container within said printing device.

9. The method according to claim 6, said used marking material comprising different colors of used marking materials, said used marking material producing prints having inconsistent colors.

10. The method according to claim 6, said used marking material is unprocessed and untreated and comprises toner, developer, and debris.

11. A proof printing device comprising:

a marking material supply container containing used marking material, said used marking material being previously used in a previous printing process and previously removed from one or more photoreceptors;

a photoreceptor adjacent said marking material supply container, said marking material supply container feeding said used marking material to said photoreceptor; and a sheet transport device adjacent said photoreceptor, said sheet transport device feeding a sheet of media to said photoreceptor, said photoreceptor transferring said used marking material to said sheet of media in a printing process performed by said printing device that produces proof prints, said proof prints comprising printed sheets used to verify at least one of content and layout of printed material, said proof prints not being required to comply with a print quality or print durability standard.

12. The proof printing device according to claim 11, further comprising a material hopper positioned on an exterior of said printing device and having an opening that receives said used marking material, said material hopper loading said used marking material into said marking material supply container.

13. The proof printing device according to claim 11, further comprising:

a cleaning device adjacent said photoreceptor, said cleaning device removing excess marking material from said photoreceptor after said used marking material is transferred to said sheet of media, and a material transport device connected to said cleaning device, said material transport device feeding said excess marking material from said cleaning device to said marking material supply container within said printing device.

14. The proof printing device according to claim 11, said used marking material comprising different colors of used marking materials, said used marking material producing prints having inconsistent colors.

15. The proof printing device according to claim 11, said used marking material is unprocessed and untreated and comprises toner, developer, and debris.

16. A proof printing device comprising:

a marking material supply container containing used marking material, said used marking material being previously used in a previous printing process and previously removed from one or more photoreceptors;

a photoreceptor adjacent said marking material supply container, said marking material supply container feeding said used marking material to said photoreceptor;

a sheet transport device adjacent said photoreceptor, said sheet transport device feeding a sheet of media to said photoreceptor, said photoreceptor transferring said used marking material to said sheet of media in a printing process performed by said printing device that produces proof prints, said proof prints comprising printed sheets used to verify at least one of content and layout of printed material, said proof prints not being required to comply with a print quality or print durability standard, and a heating element adjacent said photoreceptor, said heating element fusing said used marking material to said sheet of media at a temperature that is insufficient to comply with said print quality or print durability standard.

17. The proof printing device according to claim 16, further comprising a material hopper positioned on an exterior of said printing device and having an opening that receives said used marking material, said material hopper loading said used marking material into said marking material supply container.

18. The proof printing device according to claim 16, further comprising:

a cleaning device adjacent said photoreceptor, said cleaning device removing excess marking material from said photoreceptor after said used marking material is transferred to said sheet of media, and a material transport device connected to said cleaning device, said material transport device feeding said excess marking material from said cleaning device to said marking material supply container within said printing device.

19. The proof printing device according to claim 16, said used marking material comprising different colors of used marking materials, said used marking material producing prints having inconsistent colors.

20. The proof printing device according to claim 16, said used marking material is unprocessed and untreated and comprises toner, developer, and debris.

* * * * *